United States Patent [19]

Gauthier

[11] 4,210,049

[45] Jul. 1, 1980

[54] TUBULAR FRAME SUPPORTED, CANTILEVERED CHAIN SAW

[76] Inventor: R. Raymond Gauthier, 9 Chiswick Rd., Hudson, N.H. 03051

[21] Appl. No.: 971,802

[22] Filed: Dec. 21, 1978

[51] Int. Cl.[2] ..... B27B 17/02; B27G 19/00

[52] U.S. Cl. ..... 83/796; 83/574; 144/288 R; 83/788

[58] Field of Search ..... 83/574, 796, 797, 798, 83/799, 788; 144/288 R

[56] References Cited

U.S. PATENT DOCUMENTS

| | | | |
|---|---|---|---|
| 780,476 | 1/1905 | Bens | 83/796 |
| 1,190,739 | 7/1916 | Edwards | 83/798 |
| 1,952,270 | 3/1934 | March et al. | 83/798 |
| 2,759,501 | 8/1956 | Kliever | 83/797 |
| 2,851,067 | 9/1958 | Greenslate | 83/796 |
| 3,053,290 | 9/1962 | Fitzgerald | 83/574 |
| 3,254,686 | 6/1966 | Boyd et al. | 83/796 |
| 3,433,277 | 3/1969 | Ribley | 83/796 |
| 3,623,517 | 11/1971 | Neumann | 83/796 X |
| 4,123,957 | 11/1978 | Niemela et al. | 83/796 |
| 4,127,046 | 11/1978 | Jackson | 83/798 |

FOREIGN PATENT DOCUMENTS

| | | | |
|---|---|---|---|
| 55394 | 2/1891 | Fed. Rep. of Germany | 83/788 |

*Primary Examiner*—Donald R. Schran

*Attorney, Agent, or Firm*—Pearson & Pearson

[57] ABSTRACT

A foldable, hollow tubular frame, having a pair of elongated,spaced-apart legs, supports an elongated shaft rotatable on a horizontal axis at about shoulder level, with a conventional motor driven chain saw removably affixed to the shaft outside one end of the frame in cantilever position. An elongated trough extends horizontally of the frame at about waist level and the lower portion of the frame is anchored, or weighted, to avoid tipping. A control lever handle extends from the shaft alongside the saw, within the frame, so that the operator is on the chain side but out of the chain plane.

10 Claims, 5 Drawing Figures

TUBULAR FRAME SUPPORTED, CANTILEVERED CHAIN SAW

BACKGROUND OF THE INVENTION

It has heretofore been proposed to mount a power driven chain saw on a double top bar saw horse with the cutting chain of the saw pivotable at about waist height to swing down into the space between the bars to cut a board when the operator lifts the rear handle of the saw. Exemplary of such a structure is that disclosed in U.S. Pat. No. 3,053,290 of Sept. 11, 1962 to Fitzgerald.

It has also been proposed to support a cluster of horizontally disposed logs in the jaws of a logging machine, and to provide a horizontally movable plate for pushing the butts of the logs sidewise into the path of an automatically controlled chain saw, pivoted near one end of the cluster to successively cut the logs. Such a timber harvesting apparatus is disclosed in U.S. Pat. No. 3,254,686 to Boyd June 7, 1966. Since the operation of the saw is automatic, powered and remote controlled, standing in front, or rear, of the plane of the cutting chain is not a problem and foldability and low cost for the average householder is also not a problem.

SUMMARY OF THE INVENTION

In this invention, the single log to be cut is supported at a convenient level above ground such as at about waist level, in an elongated V shaped trough of predetermined length. The trough is preferably foldable flatwise against an upstanding generally U shaped frame, formed of hollow tubes, or pipes. The lower portions of the pair of parallel legs of the frame are anchored against toppling by being inserted in sockets embedded in the ground or by having a second pair of shorter legs forming a pivotable foldable saw horse with the four legs affixed to a wooden platform. Each of the pair of longer legs has a sleeve at the top, at above waist height and preferably at about shoulder height, there being a shaft rotatable on a horizontal axis in the sleeves.

A motor driven chain saw of any suitable, commercially available type is detachably affixed to the shaft, outside one end of the frame, in cantilever fashion so that the cutting chain is aligned in the vertical plane in which a log, slid along the trough, is to be cut.

Unlike devices of the prior art in which the operator must stand in back of the chain saw, in the path of a loose, flying cutting chain, and in which the motor obscures vision of the cut, in this invention the operator stands in front of the saw but to one side of the chain path. This is possible because a lever arm handle with a throttle control at the free terminal end, has its base affixed to the shaft, at a predetermined distance away from the chain saw, and within the confines of the frame, and extends upwardly and outwardly in the direction of the cutting chain so that the operator may stand in front, but at one side, to operate the saw.

The foldable, hollow tubular frame maybe easily stored or moved from place to place by one operator alone, for cutting firewood in the woods. By so supporting the heavy chain saw on a light portable frame, the operator can cut logs all day long without having the weight of the saw to tire him. By pivotally mounting the chain saw at a level well above the level of the log trough, the chain saw is normally horizontal rather than normally vertical, so that oil leakage is avoided and so that the cutting chain moves from horizontal to cut rather than moving down from vertical to cut as in the above mentioned Boyd patent.

DESCRIPTION OF A PREFERRED EMBODIMENT

Figure 1:
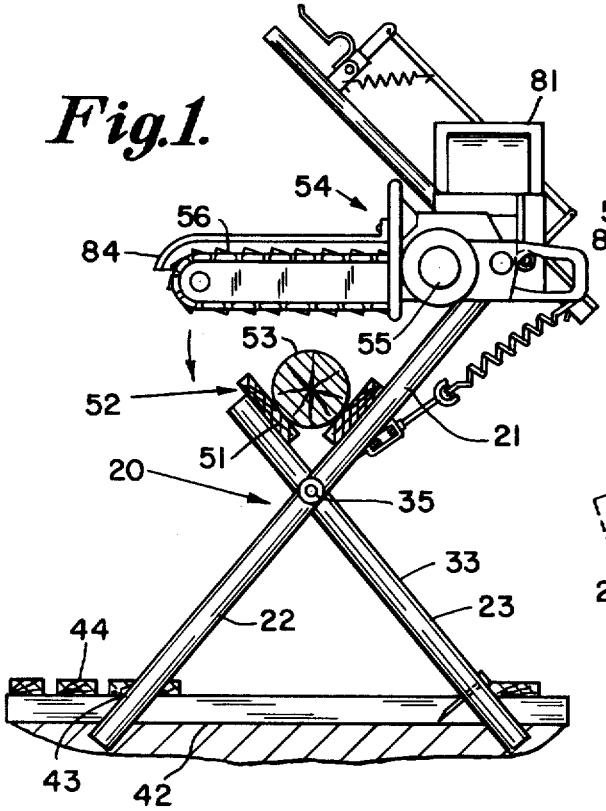
FIG. 1 is a side elevation of the portable chain saw support of the invention.
Figure 2:
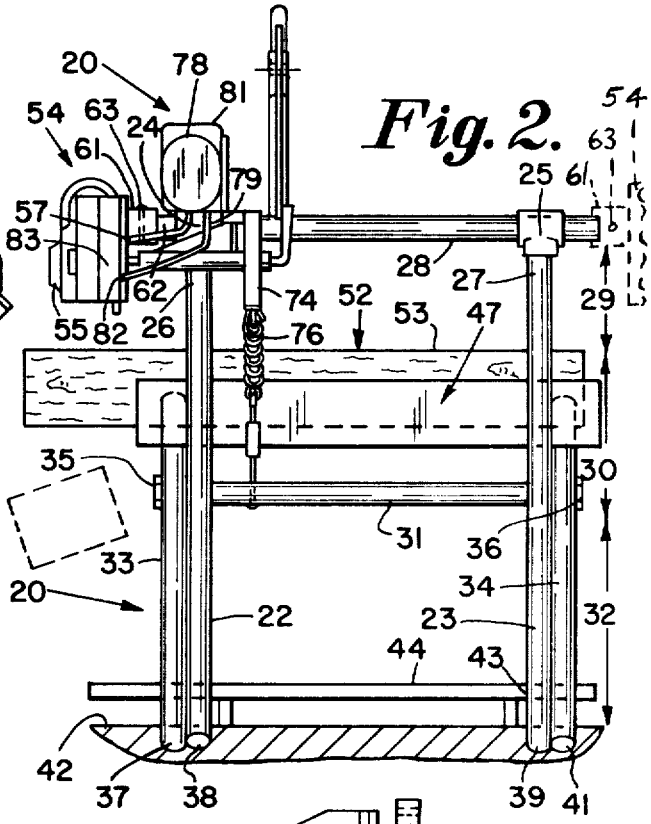
FIG. 2 is a rear elevation of the device shown in FIG. 1.

As shown in FIGS. 1 and 2 the chain saw support 20, of the invention, includes a generally inverted U shaped frame 21 formed by a pair of elongated legs 22 and 23, of hollow tubes, or pipes, each having a sleeve 24 or 25 at one end 26 or 27, which sleeves are are at about shoulder level above ground level when the frame 21 is upstanding. An elongated shaft 28 is rotatable on a horizontal axis within the sleeves 24 and 25 in the upper portion 29 of the frame. A pipe or tube 31 is affixed parallel to shaft 28, between the legs 22 and 23, in the intermediate portion 32 of frame 21 at about waist level above ground level.

In the embodiment of FIGS. 1 and 2 the support 20 includes a pair of shorter legs 33 and 34 each pivoted by a bolt 35 or 36, to the intermediate portion of legs 22 and 23 at about waist level and at pipe 31 to form a "saw horse" or "saw buck". The lower ends 37, 38, 39 and 41 of the two pairs of legs may be embedded below ground level 42 as anchoring means preventing overturn or toppling of the frame 21. Preferably however, the foldable legs 22, 23, 33 and 34 are detachably affixed in suitable holes 43 in a portable wooden platform 44 upon which the operator stands so that his weight prevents overturn of the frame.

Figure 3:
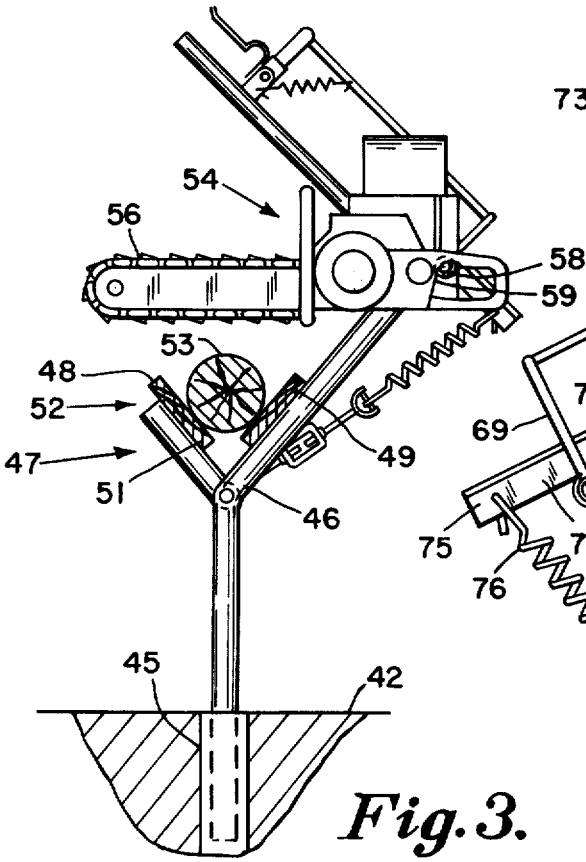
FIG. 3 is a side elevation, similar to FIG. 1, showing another embodiment of the invention.
Figure 4:
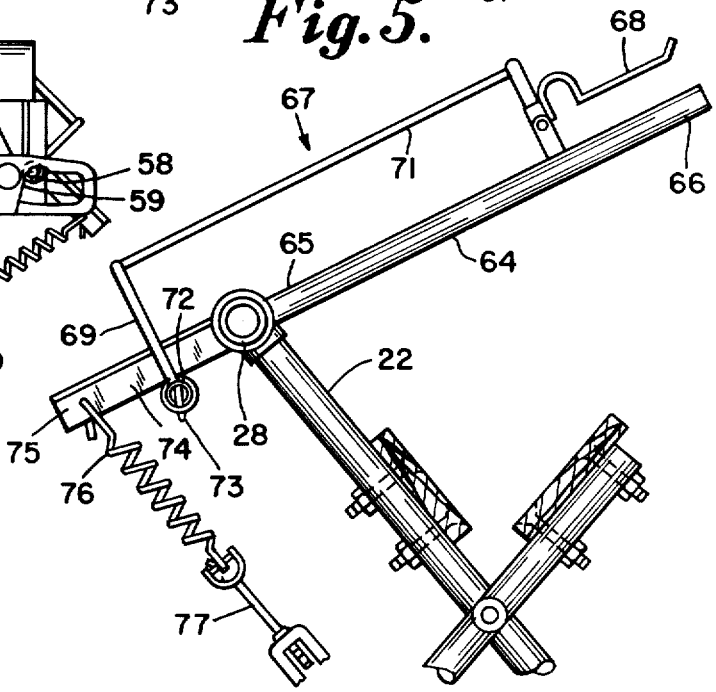
FIG. 4 is an enlarged fragmentary, side elevation, of the throttle control means and spring counter balance mechanism of the ivention.

Alternatively the frame may be of simplified construction as shown in FIG. 3 wherein there are no shorter legs 33 and 34, but the lower ends of the longer legs 22 and 23 are slidably inserted each in one of a pair of cylindrical pipes such as shown at 45; the pipes 45 being embedded below ground level 42. The elongated legs 22 and 23 are bent rearwardly as at 46 to support the shaft 28 in the same position as shown in FIGS. 1 and 2.

Log trough means 47 is provided in the form of a pair of angularly disposed, elongated, side walls 48 and 49 supported on the legs 22 at the rear and on the elements 51 at the front to form a foldable trough 52 of V shaped cross section for slidably supporting a single log 53. Trough 52 is thus at about waist level about ground level 42, to extend parallel to shaft 28 in the intermediate portion 32 of the frame 21.

The power chain saw 54 is of a heavy duty commercially available type such as a McCulloch 380, or a Jonsereds 621, both well known in the trade and having a motor 55, cutting chain 56, oil supply aperture 57, trigger 58 and throttle 59. The chain saw 54 is cantilevered relative to frame 21, and detachably affixed by an integral sleeve 61 on one end 62 of shaft 28 by a pin 63 fitting in registering holes in sleeve and shaft so that it will rotate, or pivot, with the shaft but can be easily removed for transport or storage.

Thus as shown in FIG. 2, the chain saw 54 is normally horizontal at shoulder level, well above log level of trough 52, with the cutting chain normally poised outside the frame 21 and above the proposed cutting line on the log 53 which has been slid along the trough into one of the successive cutting positions.

To permit the operator to stand in front of the support 20, on the cutting chain side, but out of the path of a broken chain, a lever arm handle 64 has its base end 65 detachably secured to the shaft 28 for rotation therewith, and thence extends outwardly and upwardly to a free terminal end 66 at a location inwardly of the leg 22, within frame 21, and alongside the path, or cutting plane, of cutting chain 56.

Figure 5:
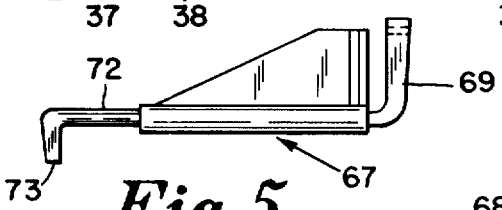
FIG. 5 is an enlarged, fragmentary, rear elevation of the crank arm element of the throttle control means.

Throttle control means 67 is provided including a fingertip throttle control lever 68 pivoted to the end 66 of handle 64 and a corresponding lever 69 pivoted at the base end 65, the levers 68 and 69 being connected by a link 71 and the lever 69 being integral with the horizontal crank element 72 (FIG. 5) so that its end 73 actuates throttle 59 chain saw 54 when lever 68 is actuated.

A second lever 74 is detachably affixed to shaft 28, to extend outwardly and rearwardly in a direction opposite to the forward projecting handle 64, the end 75 of lever 74 being connected by coil spring 76 and shackle 77 to pipe 31 to spring bias the chain saw into its normal horizontal position.

Because the invention permits the operator to use the chain saw all day long without tiring because of the weight of the saw, an auxiliary container 78 of oil is mounted on the sleeve 24 and connected by a flexible tube 79 to the oil aperture of the chain saw to keep it well lubricated.

To also enable all day cutting, without interruption, an auxiliary gasoline tank 81 may also be mounted on sleeve 24, and connected by a suitable flexible tube 82 to the gasoline tank 83 of the chain saw. A chain guard 84 is also provided for safety.

It is within the scope of the invention, for a plurality of chain saws 54 to be each mounted on a sleeve 61 removably affixed to the shaft 28 by a pin 63, on the shaft 28 so that simultaneous cuts of firewood may be made from a single log supported in the trough. Such an additional chain saw is depicted in dotted lines in FIG. 2.

I claim:

1. A chain saw support comprising:

a generally U shaped frame having a pair of elongated legs, each with a sleeve at one end rotatably supporting an elongated shaft therewithin at about shoulder level above ground level, and each with an opposite lower end having means for anchoring the same to the ground, log trough means supported at about waist height above ground level on said U shaped frame and extending in parallelism with said shaft to slidably support a log therein, with the end to be cut extending beyond said trough and outside one said leg;

a power chain saw, cantilever-supported on one end of said shaft outside said one leg, and having the cutting chain thereof positioned to move in a vertical plane passing through the desired cut line of the log;

a lever arm handle detachably affixed to said shaft for movement therewith and extending outwardly and upwardly from said shaft in the same direction as said cutting chain of said saw but at a location inwardly of said one leg to a free terminal end;

and throttle control means at said free end of said arm connected to the throttle of said chain saw;

whereby an operator may stand in front of said lever arm handle out of the path of said cutting chain, and lower said handle, while actuating said throttle control means, to oscillate said chain saw downwardly from the horizontal on the axis of said shaft, to cut off successive ends of a log in said trough means.

2. A chain saw support as specified in clain 1 wherein:

said shaft includes a second lever arm integral therewith and extending outwardly therefrom, in a direction opposite to the direction of said first mentioned lever arm, at a location inwardly of said one leg to a free terminal end and, coil spring means connecting the free terminal end of said second lever arm with a portion of said log through means for biasing said chain saw into upward, horizontal nonoperating position.

3. A chain saw support as specified in claim 1 wherein:

said chain saw support includes a pair of hollow cylindrical pipes embedded below ground level and each leg of said frame is received in one of said pipes to retain said frame in upstanding position.

4. A chain saw support as specified in claim 1 wherein:

said means anchoring said U shaped frame to the ground includes a second pair of legs, shorter than said first pair of legs, and having upper ends each pivoted to one of said elongated legs at about waist level to form a brace therefor, and a wood platform resting on the ground in the area surrounding said chain saw support, said platform having the lower ends of all of said legs affixed thereto.

5. A chain saw support as specified in claim 1 wherein:

said throttle control means includes a throttle lever pivoted to the outer end of said lever arm and mechanical linkage connecting the same to the throttle built into said chain saw, whereby depression of said throttle lever produces a corresponding actuation of said built-in throttle.

6. A chain saw support as specified in claim 1 plus a container of oil mounted on the sleeve of the elongated leg nearest to said chain saw, so as not to pivot with said shaft;

and a flexible tube connecting said container to the oil tank of said chain saw for automatically lubricating the same during use.

7. A chain saw support as specified in claim 1 wherein:

said cantilever support of said chain saw on said shaft outside said one leg includes an elongated tube affixed to said chain saw and sleeved over said shaft and a removable pin in registering holes in said tube and shaft whereby removal of said pin enables removal of said saw for repair, storage or shipment of said support.

8. A foldable, collapsible, chain saw support comprising:

frame means having an upper portion supporting an elongated shaft for rotation on a horizontal axis at about shoulder level, an intermediate portion supporting an elongated trough, parallel to said shaft, at about waist level and a lower portion adapted to support said frame means in upstanding position relative to ground level a power chain saw affixed to said shaft to rotate therewith on said horizontal axis, alongside said frame means, from a horizontal position above the line of cut on a log in said trough downward in a vertical plane to a position below said line of cut a lever arm handle having a base end affixed to said shaft at a spaced distance from said saw, within said frame means, and extending therefrom for a substantial distance away from said shaft to permit an operator to actuate said saw without being in the path of the cutting chain of said saw;

and throttle control means at the free terminal end of said handle, operably connected to the throttle of said chain saw, for finger tip control of the speed of said saw.

9. A combination as specified in claim 8 wherein:

said frame means includes a pair of elongated, parallel legs supporting said shaft and a pair of shorter parallel legs each pivoted to one of said legs at about said waist level, to constitute the lower portion of said frame means supporting the same in a foldable "saw horse" manner said trough comprising a pair of angularly disposed walls devining a V in cross section, one wall being foldable against the other flatwise on said frame means when not in use.

10. A combination as specified in claim 8 wherein:

said throttle control means includes a finger tip lever at the free end of said handle, mechanical linkage connecting said lever to a corresponding lever at the base of said handle and a horizontal extending crank element actuated by said corresponding lever to operate the throttle of said chain saw.

* * * * *